United States Patent [19]

Kelly

[11] 4,231,573

[45] Nov. 4, 1980

[54] BOWLING LANE AND SURFACE

[75] Inventor: Peter B. Kelly, Coshocton, Ohio

[73] Assignee: General Electric Company, Worthington, Ohio

[21] Appl. No.: 926,604

[22] Filed: Jul. 21, 1978

Related U.S. Application Data

[60] Division of Ser. No. 901,791, May 1, 1978, abandoned, which is a continuation of Ser. No. 506,069, Sep. 16, 1974, abandoned.

[51] Int. Cl.[2] ..... A63D 1/04

[52] U.S. Cl. ..... 273/51; 156/61; 156/307.3; 428/204; 428/207; 428/211; 428/528; 428/530; 428/535; 428/537; 428/920

[58] Field of Search ..... 156/61, 309; 273/51; 428/204, 207, 211, 528, 530, 535, 537, 920

[56] References Cited

U.S. PATENT DOCUMENTS

| | | | |
|---|---|---|---|
| 2,531,168 | 11/1950 | Snyder | 273/51 |
| 3,135,643 | 6/1964 | Michl | 428/204 |
| 3,373,070 | 3/1968 | Fuerst | 428/204 |

*Primary Examiner*—James C. Cannon

*Attorney, Agent, or Firm*—Morgan, Finnegan, Pine, Foley & Lee

[57] ABSTRACT

A bowling lane has a decorative laminate surface characterized by a falling ball impact resistance of at least about 60 inches, a coefficient of friction of about 0.18 and a Taber abrasion resistance of at least about 500 cycles.

26 Claims, No Drawings

BOWLING LANE AND SURFACE

This application is a division of application Ser. No. 901,791, filed on May 1, 1978, and now abandoned which is a continuation of application Ser. No. 506,069, filed on Sept. 16, 1974, and now abandoned.

This invention relates to new and improved bowling lane structures. More particularly, it relates to new and improved surfaces for bowling lanes.

Generally, standard bowling lanes are constructed of suitably finished hardwood blocks or planking. In a lane bed about 41 to 42 inches wide, the construction typically consists of from about 39 to 42 maple planks or boards about one inch thick plaid edgewide in line with the longitudinal axis of the lane. The surface of the lane is made flat and coated with varnish or lacquer which is then treated as with mineral oil to reduce wear and adjust the coefficient of friction or slippage of the surface in order to produce uniform action and control of the bowling ball. The surface finish consists typically of a nitrocellulose or polyurethane lacquer which can be treated with plasticizers and other additives to provide with the oil treatment the desired wear and slippage or friction characteristic.

While wooden lanes have been in use for many years, they are subject to a number of deficiencies which have defied correction despite much work expended on the problem. For example, present wooden lanes are severely damaged in the areas of ball release and at the pin deck. Such damage in the ball release area is intensified by lofting of the ball which, upon impact, dents the lacquered and oiled wooden surface and damages the lane to a lesser degree even with normal release of the ball. Surface damage in the pin deck area is primarily caused by contact of the struck pins with the surface. Under ordinary circumstances, standard bowling lanes are inspected and often refinished and resurfaced on an annual basis. Such refinishing is necessary in order to meet set bowling standards and in order to provide uniformity of all lanes so that comparable performance and scoring can be attained insofar as these factors are controlled by the physical condition of the bowling lane itself as opposed to the skill of the bowler.

It will be seen from the above that there is a need for bowling lanes and surfaces therefor which are more resistant to physical abuse and wear, have uniformity of surface and which can maintain these qualities over a long period of time. Of particular interest in this respect is the resistance of the surface to bowling ball impact and a suitable coefficient of friction and resistance to abrasion which, in combination with the mineral oil dressing applied to the lane, will give an optimum resistance to wear while at the same time providing the proper slippage to the thrown ball so that uniform ball action will result on any lane so surfaced when thrown in the same manner, and it is a primary object of this invention to provide bowling lanes and surfaces for bowling lanes which will accomplish such purpose.

Briefly, according to the present invention, particular decorative plastic laminates having a thermosetting resin impregnated core overlaid with a decorative layer and a protective thermosetting resin impregnated paper overlay or thermosetting resin overlay coating are used to provide improved bowling lanes and surfaces therefor.

Those features of the invention which are believed to be novel are set forth with particularity in the claims appended thereto. The invention will, however, be better understood and further advantages and objects thereof appreciated from a consideration of the following description.

It has been found that bowling lane surfaces in accordance with the present invention have a NEMA Standard 8-19-64 falling ball impact resistance of over 60 inches as compared to 32 inches for a typical varnished or lacquered hardwood lane. When a 16-pound standard bowling ball was dropped on the bowling lane of this invention from a height of 3 feet, there was no effect. Both with polyurethane varnish and the nitrocellulose lacquer treated wooden bowling lanes, a deep surface dent resulted from such treatment and the wood fibers of the surface were torn. As measured by the Taber abraser, the NEMA Standard 8-20-1962 abrasion resistance of the present lanes is from about 500 cycles to 2500 cycles depending on the particular surface, whereas the polyurethane varnish and nitrocellulose lacquer finished lanes have a Taber abrasion resistance of 40 cycles and 25 cycles respectively. The resistance of the present surfaces to a burning cigarette in accordance with NEMA Standard 8-19-64 is 300 seconds as opposed to 90 seconds to charring for the polyurethane varnish and 24 seconds to burning with the nitrocellulose lacquer. The slip or coefficient of friction of the present surfaces is 0.18 as compared to 0.18 for typical polyurethane varnished layers and 0.16 for typical nitrocellulose lacquer coated lanes, all measurements being taken with an oil-treated surface. The present surfaces are furthermore resistant to staining by alcohol, detergent, shoe polish, and mustard whereas polyurethane varnished surface lanes are stained by mustard, and nitrocellulose lacquer surface lanes are stained by alcohol, shoe polish and mustard. The 60 degree gloss of the present lanes is also comparable to those of present hardwood lanes surfaced with nitrocellulose lacquer.

Any of a number of substrates can be used in connection with the surface of the present invention including natural wood such as maple planks and consolidated wood fibers, plywood, flakeboard, chipboard and hardboard. Also useful are materials such as concrete, cement-asbestos board, filled asphalt, stone and metal sheets, the non-flammable materials being useful where fire resistance is desirable.

The bowling lane surfaces or laminates of the present invention are readily made. The core sheets are typically of kraft paper which can be impregnated with any of the thermosetting resins conventionally used in the production of decorative laminates. The most common of these resins is a condensation product of a phenol and an aldehyde and generally an alkaline catalyzed phenol formaldehyde condensation product. A specific phenolic resin used in this connection is a light colored, thermosetting, general purpose phenol formaldehyde resin of the above description sold by the Monsanto Company under the name of Resinox 470. As in typical decorative laminates, the core sheets of kraft paper or creped kraft paper or selected combinations of such papers are overlaid with a so-called print sheet which imparts the decorative effect as of wood grain or any other finish to the laminate. While the print sheet can be impregnated as is usual in ordinary decorative laminates, it has been found that a lesser amount than usual of the thermosetting resin impregnant is desirable in the print sheet to toughen the surface of the laminate and make it more impact and fracture resistant in order to resist grooving of the surface and denting. Any of a number of thermosetting resins can be used for impregnating the print sheet where this is indicated including, preferably, a condensation product of melamine and an aldehyde, such materials being characterized by excellent wearing, translucency and resistance to discoloring. A specific material found useful in this connection is a modified melamine formaldehyde reaction product sold by American Cyanamid Company under the name of Cymel 428. This resin is a white, free-flowing powder specifically designed for the treatment of paper to be used in decorative laminates. The resin is readily soluble in water or in alcohol-water solvents and gives a clear, colorless solution which is stable at 50 percent by weight solids content for at least two days at room temperature. Typical properties of a 50 percent aqueous solution of this resin at 25° C. include a pH of 8.8 to 9.6, a Gardner viscosity of A to B, a solids content at maximum dilution in water of 26 percent and a solids content at maximum dilution in water of 26 percent. However, other resins such as ureas, aminotriazines, light highly purified phenolic resins, polyester resins including unsaturated alkyd-vinyl monomer types, acrylics, ethoxyline resins and the like can also be used. Among the melamine resins which can be used are the several more fully described in U.S. Pat. No. 2,605,205. In preparing the plastic laminate, the core kraft paper is impregnated in any desired manner with the thermosetting resin and dried, the resin content of the dried core paper sheet before consolidation ranging generally from about 25 to 29 percent by weight for ordinary kraft paper and from about 34 to 37 percent by weight of resin for the normally used creped kraft paper.

Where a paper overlay or protective layer is used, this is normally of a highly purified, transparent, alpha cellulose although it can also consist of other transparent or highly translucent cellulosic or synthethic resin fibers such as those of rayon or mixtures of such fibers such as those described in U.S. Pat. No. 2,816,851, among others. This material is impregnated with a melamine resin such as that above and usually dried to a resin content of from about 33 to 42 percent by weight before consolidation.

If desired, the abrasion and wear resistance of the paper layer can be increased by incorporating abrasive materials such as finely divided silica, silicon carbide, emery, diamond, tungsten carbide, titanium carbide, boron nitride, aluminum oxide and mixtures of such materials with each other and with other finely divided materials, the wear or abrasion resistance of the overlay being specifically tailored as desired by using materials of the desired hardness. These materials can be uniformly distributed throughout the overlay as by the teaching of U.S. Pat. No. 3,373,070, to give uniform abrasion resistance as the overlay is worn away or they can be concentrated in the surface of the overlay or graded through the thickness of the overlay as desired.

In lieu of the thermosetting resin impregnated paper overlay, there can be used a thermosetting resin as such or compositions which take the place of the overlay. Typical of such thermosetting resin composition overlays are those described in U.S. Pat. Nos. 3,135,643 and 3,373,071 which are included by reference herein. According to these patents, a surface coating composition for decorative laminates is provided comprising a thermosetting resin, silica flour and a finely divided fibrous material in the form of discrete fibers. The silica flour and the finely divided fibrous material have a refractory index approximating that of the cured thermosetting impregnating resin where a transparent or highly translucent effect is desired. It will be realized, of course, that the silica flour can be substituted wholly or in appropriate amounts by the other hard materials, including those mentioned above, to obtain good abrasion resistance and transparency effects. This coating composition greatly improves the abrasion resistance of the laminates to which it is applied.

The following examples illustrate the practice of the present invention, it being realized that they are to be taken as exemplary only and not as limiting in any way.

EXAMPLE 1

This example illustrates a bowling lane having a decorative laminate surface incorporating a thermosetting resin impregnated paper overlay. There was prepared an overlay of alpha cellulose paper impregnated with a 50 percent water solution of melamine formaldehyde resin, specifically Cymel 428, the impregnated paper being dried to a resin content of 65 percent by weight. There was also prepared in a similar manner core layers of 130 pound basis weight kraft paper and 140 pound basis weight creped kraft paper which were impregnated with a 50 percent solution of standard alkaline catalyzed phenol-formaldehyde resin, the dried resin content of each such core layer being about 30 percent by weight. The laminate was prepared by successively superimposing two phenolic impregnated kraft paper sheets, one phenolic resin impregnated creped kraft paper sheet, thirteen phenolic resin impregnated kraft paper sheets, one 55-pound basis weight raw or unimpregnated print sheet and a melamine resin impregnated overlay paper as described above. The laminate so laid up was placed between polished stainless steel panels and cured for 15 to 18 minutes at 130° to 135° C. at 1500 psi, the laminate then being cooled still under pressure to below 40° C. and removed from the press. Actually, the laminating process is of a time-temperature-pressure nature and can be prepared by curing for from about 20 to 25 minutes at from about 130° C. to 150° C. at pressures ranging from about 1000 psi to about 1500 psi. The resulting laminate was 130 mils thick and was sanded to a 125 mil thickness. As intimated above, the less melamine present in the print, the tougher the surface and the more impact and fracture resistant it is. Thus, in this example, a raw or unimpregnated print layer was used so that it could be impregnated but not excessively by reason of melamine resin migration from the melamine resin impregnated overlay paper. The finished laminate was cured to size and cemented using contact cement to an existing hardwood bowling lane. Joints between laminate sheets were filled with elastomeric material, specifically RTV silicone calk. Other useful calks are well known polyurethane and polysulfide materials.

EXAMPLE 2

This example illustrates the practice of the present invention using in lieu of a resin impregnated paper overlay a thermosetting resin layer. The core sheets of this example were prepared as in Example 1. In lieu of the overlay sheet, an abrasion resistant, thermosetting resin composition was used prepared in accordance with Example 1 of U.S. Pat. No. 3,373,071 incorporated herein by reference. This thermosetting resin composition prepared by mixing in a high shear blender 64 parts of water, 12.5 parts of sodium carboxy methyl cellulose in 2 percent concentration and 10 parts of finely divided silica, there being added after mixing 100 parts of melamine resin, specifically Cymel 428, with further mixing to which resulting mixture there was added again with thorough mixing 10 parts of Avicel microcrystalline cellulose. This resinous composition diluted to 50 percent solids in water, was used to impregnate a 55-pound basis weight print sheet to a dried resin composition content of 50 percent by weight. The various layers were then superimposed one upon the other and pressed under heat as described in Example 1 to produce a laminate having an unsanded thickness of 130 mils which was reduced by sanding the back or core side to a final total thickness of 125 mils. The finished laminate was cut to size and cemented using contact cement to an existing hardwood bowling lane. Joints between laminate sheets were filled with elastomeric material, specifically the material of Example 1.

The following table shows the results of various tests performed on bowling lanes surfaced with the material of Examples 1 and 2 as compared with standard bowling lanes finished respectively with polyurethane varnish and nitrocellulose lacquer, all tests being carried out in accordance with NEMA publication LD 1-1964.

| Test | National Electrical Manufacturers Association Standard Tests (NEMA Pub. No. LD 1-64) | | | |
|---|---|---|---|---|
| | Example 1 | Example 2 | Polyurethane Varnish** | Nitrocellulose Lacquer** |
| Impact, falling ball | >60 inches | >60 inches | 32 inches | 30 inches |
| Impact,* 16 pound bowling ball, 3 feet | No effect | No effect | Deep dent, torn wood fibers | Deep dent, torn wood fibers |
| Abrasion Resistance (Taber) | 500 cycles | 2500 cycles | 40 cycles | 25 cycles |
| Cigarette Resistance | 300 seconds | 300 seconds (charred) | 90 seconds (charred) | 24 seconds (on fire) |
| Hardness | | | | |
| Rockwell M | | 114 | ---Too soft to measure--- | |
| Barcol | | 65 | 0 | 0 |
| Coefficient of Friction | 0.18 | 0.18 | 0.18 | 0.16 |
| Staining | | | | |
| Alcohol | No | No | No | Yes |
| Detergent | No | No | No | No |
| Shoe polish | No | No | No | Yes |
| Mustard | No | No | Yes | Yes |
| Gloss, 60° | | | | |
| Length | | 75 | 74 | 62 |
| Cross | | 72 | 68 | 44 |

*Improvised test using standard hardwood lane above **or with surfaces of invention.

From the above it will be seen that the bowling lanes of the present invention surfaced with the present decorative laminate surfacing materials are far and away superior to present bowling lane or alley surfaces from the point of view of impact and abrasion resistance. At the same time, the present surfaces match or very closely approximate the coefficient of friction of present surfaces so that slippage and control of the ball on the mineral oiled dressed lane is not changed. This is borne out by the experience of bowlers using the new lanes.

What I claim as new and desire to secure by Letters Patent of the United States is:

1. A bowling lane having a surface characterized by a falling ball impact resistance of at least 60 inches, a coefficient of friction of about 0.18 and a Taber abrasion resistance of at least about 500 cycles, said bowling lane comprising a substrate selected from the group consisting of natural wood, consolidated wood fibers, plywood, flakeboard, chipboard and hardboard, and at least one decorative plastic laminate sheet secured to the surface of said substrate, said plastic laminate sheet comprising a plurality of thermosetting resin impregnated fibrous core sheets, a resin impregnated decorative fibrous print sheet, and an overlying resin containing protective layer.

2. A bowling lane having a surface characterized by a falling ball impact resistance of at least 60 inches, a coefficient of friction of about 0.18 and a Taber abrasion resistance of at least about 500 cycles, said bowling lane comprising a substrate selected from the group consisting of natural wood, consolidated wood fibers, plywood, flakeboard, chipboard and hardboard, and at least one decorative plastic laminate sheet secured to the surface of said substrate, said plastic laminate sheet comprising a plurality of thermosetting resin impregnated fibrous core sheets, a melamine resin impregnated decorative fibrous print sheet, and an overlying melamine resin containing protective layer.

3. A bowling lane in accordance with claim 2, wherein the overlying protection layer is a fibrous sheet impregnated with the melamine resin.

4. A bowling lane in accordance with claim 3, wherein said overlying protective layer has abrasion-resistant material incorporated in the layer.

5. A bowling lane in accordance with claim 2, wherein the fibrous core sheets and the fibrous print sheet are each of paper.

6. A bowling lane in accordance with claim 2, wherein the substrate is natural wood.

7. A bowling lane in accordance with claim 2, wherein the substrate is consolidated wood fibers.

8. A bowling lane in accordance with claim 2, wherein the substrate is plywood.

9. A bowling lane in accordance with claim 2, wherein the substrate is flakeboard.

10. A bowling lane in accordance with claim 2, wherein the substrate is chipboard.

11. A bowling lane in accordance with claim 2, wherein the substrate is hardboard.

12. A decorative plastic laminate sheet of a length, thickness and a width for securing to a substrate selected from the group consisting of natural wood, consolidated wood fibers, plywood, flakeboard, chipboard, and hardboard to form therewith all or part of a bowling lane having a surface characterized by a falling ball impact resistance of at least 60 inches, a coefficient of friction of about 0.18 and a Taber abrasion resistance of at least about 500 cycles, said plastic laminate sheet comprising a plurality of thermosetting resin impregnated fibrous core sheets, a resin impregnated decorative fibrous print sheet, and an overlying resin containing protective layer.

13. A decorative plastic laminate sheet of a length, thickness and a width for securing to a substrate selected from the group consisting of natural wood, consolidated wood fibers, plywood, flakeboard, chipboard, and hardboard to form therewith all or part of a bowling lane having a surface characterized by a falling ball impact resistance of at least 60 inches, a coefficient of friction of about 0.18 and a Taber abrasion resistance of at least about 500 cycles, said plastic laminate sheet comprising a plurality of thermosetting resin impregnated fibrous core sheets, a melamine resin impregnated decorative fibrous print sheet, and an overlying melamine resin containing protective layer.

14. A laminate sheet in accordance with claim 13, wherein the overlying protective layer is a fibrous sheet impregnated with the melamine resin.

15. A laminate sheet in accordance with claim 14, wherein said overlying protective layer has abrasion-resistant material incorporated in the layer.

16. A laminate sheet in accordance with claim 13, wherein the fibrous core sheets and the fibrous print sheet are each of paper.

17. A decorative plastic, laminate sheet of a length and width for securing to a substrate selected from the group consisting of natural wood, consolidated wood fibers, plywood, flakeboard, chipboard, and hardboard to form therewith all or part of a bowling lane, having a surface characterized by a falling ball impact resistance of at least 60 inches, a coefficient of friction of about 0.18 and a Taber abrasion resistance of approximately 2500 cycles, said plastic laminate sheet comprising a plurality of thermosetting resin impregnated fibrous core sheets, a melamine resin impregnated decorative fibrous print sheet, and an overlying melamine resin containing protective layer, said plastic laminate sheet having a Rockwell M hardness of approximately 114 and a Barcol hardness of approximately 65, a resistance to a burning cigarette on the order of 300 seconds and a thickness on the order of 0.125 inches.

18. The method of producing a bowling lane having a surface characterized by a falling ball impact resistance of at least 60 inches, a coefficient of friction of about 0.18 and a Taber abrasion resistance of at least about 500 cycles comprising consolidating a plurality of thermosetting resin impregnated core sheets, a resin impregnated decorative fibrous print sheet, and an overlying resin-containing protective layer under heat and pressure to produce a unitary decorative plastic laminate sheet, and securing at least one such plastic laminate sheet to a substrate selected from the group consisting of natural wood, consolidated wood fibers, plywood, flakeboard, chipboard and hardboard to produce the desired bowling lane.

19. The method of claim 18, wherein the resin in the protective layer is melamine.

20. The method of claim 19, wherein the protective layer has abrasion-resistance material incorporated in the layer.

21. The method of claim 18, wherein the substrate is natural wood.

22. The method of claim 18, wherein the substrate is consolidated wood fibers.

23. The method of claim 18, wherein the substrate is plywood.

24. The method of claim 18, wherein the substrate is flakeboard.

25. The method of claim 18, wherein the substrate is chipboard.

26. The method of claim 18, wherein the substrate is hardboard.

* * * * *